US010137336B2

(12) United States Patent
Mizutani et al.

(10) Patent No.: US 10,137,336 B2
(45) Date of Patent: Nov. 27, 2018

(54) GOLF HEAD CLUB

(71) Applicant: SUMITOMO RUBBER INDUSTRIES, LTD., Kobe-shi (JP)

(72) Inventors: Naruhiro Mizutani, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/454,314

(22) Filed: Mar. 9, 2017

(65) Prior Publication Data

US 2017/0259136 A1 Sep. 14, 2017

(30) Foreign Application Priority Data

Mar. 10, 2016 (JP) ..... 2016-047534

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 2053/0433* (2013.01); *A63B 2053/0491* (2013.01)

(58) Field of Classification Search
CPC ..... A63B 53/0466; A63B 60/53; A63B 2053/0433
See application file for complete search history.

(56) References Cited

U.S. PATENT DOCUMENTS 8,517,860 B2 8/2013 Albertsen et al.
2015/0238826 A1* 8/2015 Llewellyn ..... A63B 53/0466 473/332
2016/0346642 A1* 12/2016 Akiyama ..... A63B 53/0466

* cited by examiner

*Primary Examiner* — Michael Dennis
(74) *Attorney, Agent, or Firm* — Birch, Stewart, Kolasch & Birch, LLP

(57) ABSTRACT

Provided is a golf club head having a sole portion. In the sole portion, first and second grooves are formed extending in a toe-heel direction and recessed toward the inside of the sole portion. The first groove is disposed on a face side relative to the second groove. The first groove includes a first main inner wall and a first sub inner wall shorter than the first main inner wall. The second groove includes a second main inner wall and a second sub inner wall shorter than the second main inner wall. The first and second main inner walls are inclined so as to point upward toward the face side. The second main inner wall, when the sole portion has been placed on a ground plane, is inclined more steeply than the first main inner wall relative to the ground plane in a side cross-sectional view.

19 Claims, 10 Drawing Sheets

GOLF HEAD CLUB

CROSS REFERENCE TO RELATED APPLICATIONS

This application claims a priority to Japanese Patent Application No. 2016-047534 filed on Mar. 10, 2016, which is hereby incorporated by reference in its entirety.

FIELD OF INVENTION

The present invention relates to a golf club head.

BACKGROUND

Improvement of flight distance is a permanent theme of golfers. Therefore, in the design of golf club heads, various plans have been devised in order to improve the rebound performance of golf club heads.

Incidentally, a golf club head having a plurality of grooves formed in a sole portion is disclosed in U.S. Pat. No. 8,517,860.

SUMMARY OF INVENTION

In many cases, grooves formed in a sole portion contribute to improvement of rebound performance of a golf club head. However, when aiming to further improve rebound performance, it is not sufficient to merely form grooves, and further improvements in the configuration of grooves have been sought. The inventors of the present invention, particularly in a case of forming a plurality of grooves, considered it important to further improve the relative configuration of those grooves.

An object of the present invention is to provide a golf club head having high rebound performance.

A golf club head according to a first aspect of the present invention has a hollow structure, and is provided with a face portion, a crown portion, and a sole portion. In the sole portion, a first groove and a second groove are formed extending in a toe-heel direction and recessed toward the inside of the sole portion. The first groove is disposed on a face side relative to the second groove. The first groove includes a first main inner wall and at least one of a first sub inner wall shorter than the first main inner wall, constituting an inner wall forming the first groove. The second groove includes a second main inner wall and at least one of a second sub inner wall shorter than the second main inner wall, constituting an inner wall forming the second groove. The first main inner wall and the second main inner wall are inclined so as to point upward toward the face side. The second main inner wall, when the sole portion has been placed on a ground plane, is inclined more steeply than the first main inner wall relative to the ground plane in a side cross-sectional view.

A golf club head according to a second aspect of the present invention is a golf club head according to the first aspect, in which the first groove is configured with the first main inner wall disposed on a back side, and one of the first sub inner walls disposed on the face side, and the second groove is configured with the second main inner wall disposed on the back side, and one of the second sub inner walls disposed on the face side.

A golf club head according to a third aspect of the present invention is a golf club head according to the first aspect or the second aspect, in which, in the side cross-sectional view, an imaginary line along an inclination of the first main inner wall and an imaginary line along an inclination of the second main inner wall intersect at a position on a back side relative to the second groove and below the sole portion.

A golf club head according to a fourth aspect of the present invention has a hollow structure, and is provided with a face portion, a crown portion, and a sole portion. In the sole portion, a first groove and a second groove are formed extending in a toe-heel direction and recessed toward the inside of the sole portion. The first groove is disposed on a face side relative to the second groove. The first groove includes a first main inner wall and at least one of a first sub inner wall shorter than the first main inner wall, constituting an inner wall forming the first groove. The second groove includes a second main inner wall and at least one of a second sub inner wall shorter than the second main inner wall, constituting an inner wall forming the second groove. The first main inner wall and the second main inner wall are inclined so as to point upward toward a back side. The first main inner wall, when the sole portion has been placed on a ground plane, is inclined more steeply than the second main inner wall relative to the ground plane in a side cross-sectional view.

A golf club head according to a fifth aspect of the present invention is a golf club head according to the fourth aspect, in which the first groove is configured with the first main inner wall disposed on the face side, and one of the first sub inner walls disposed on the back side, and the second groove is configured with the second main inner wall disposed on the face side, and one of the second sub inner walls disposed on the back side.

A golf club head according to a sixth aspect of the present invention is a golf club head according to the fourth aspect or the fifth aspect, in which, in the side cross-sectional view, an imaginary line along an inclination of the first main inner wall and an imaginary line along an inclination of the second main inner wall intersect at a position on the face side relative to the first groove and below the sole portion.

A golf club head according to a seventh aspect of the present invention is a golf club head according to any of the first to sixth aspects, in which, in the side cross-sectional view, the first main inner wall and the second main inner wall are formed in the shape of a straight line, or curved in a concave shape toward the inside of the sole portion.

A golf club head according to an eighth aspect of the present invention is a golf club head according to any of the first to seventh aspects, in which the sole portion further includes a first grounding portion positioned on the face side relative to the first groove and contacting the ground plane when the sole portion has been placed on the ground plane, and a second grounding portion positioned between the first groove and the second groove and contacting the ground plane when the sole portion has been placed on the ground plane.

A golf club head according to a ninth aspect of the present invention is a golf club head according to the eighth aspect, in which, in the side cross-sectional view, the first grounding portion and the second grounding portion are configured so as to contact the ground plane in a line when the sole portion has been placed on the ground plane.

A golf club head according to a tenth aspect of the present invention is a golf club head according to the eighth aspect or the ninth aspect, in which the sole portion further includes a third grounding portion positioned on a back side relative to the second groove and contacting the ground plane when the sole portion has been placed on the ground plane.

A golf club head according to an eleventh aspect of the present invention is a golf club head according to any of the first to tenth aspects, in which the sole portion further includes a thick portion or a rib extending in the toe-heel direction in at least one of the first main inner wall and the second main inner wall.

A golf club head according to a twelfth aspect of the present invention is a golf club head according to any of the first to eleventh aspects, in which the sole portion further includes a thick portion or a rib extending in a face-back direction in at least a position of the first groove.

A golf club head according to a thirteenth aspect of the present invention is a golf club head according to any of the first to twelfth aspects, in which the first groove is shorter than the second groove in the toe-heel direction.

A golf club head according to a fourteenth aspect of the present invention is a golf club head according to any of the first to thirteenth aspects, in which, in a plan view, at least one of the first groove and the second groove extends in a shape protruding toward a back side.

According to the present invention, a plurality of grooves extending in the toe-heel direction are formed in the sole portion of the golf club head. Thus, rigidity of the sole portion in the face-back direction decreases, so the sole portion more easily deforms when striking a ball, and therefore rebound performance of the golf club head improves. Also, because these grooves are recessed toward the inside of the golf club head, the sole portion deforms to the inside when striking a ball.

According to the first aspect, the first groove and the second groove are formed in the sole portion. The first groove is disposed on the face side relative to the second groove. The first groove includes the first main inner wall and the first sub inner wall that constitute the inner wall forming the first groove. The first sub inner wall is shorter than the first main inner wall. The second groove includes the second main inner wall and the second sub inner wall that constitute the inner wall forming the second groove. The second sub inner wall is shorter than the second main inner wall. The first main inner wall and the second main inner wall are inclined so as to point upward toward the face side. In such a configuration, in the first aspect, further, when the sole portion has been placed on a ground plane, the second main inner wall is inclined more steeply than the first main inner wall relative to the ground plane in a side cross-sectional view. Accordingly, in a description with reference to FIG. 7, which shows an example of the first aspect of the present invention, when drawing an imaginary line V1' from the face side end point Q1 of the second main inner wall (a second back side inner wall 22) further toward the face side, and parallel to the inclination of the first main inner wall (a first back side inner wall 12), such an imaginary line V1' and a line corresponding to the second main inner wall (the second back side inner wall 22) intersect so as to draw a line recessed (protruding upward) toward the inside of the head. Due to such a relative inclination relationship formed between the first main inner wall and the second main inner wall, inward deformation of the sole portion when striking a ball is promoted, so the sole portion is more easily deformed when striking a ball, and the rebound performance of the golf club head further improves.

On the other hand, according to the fourth aspect, the first groove and the second groove are formed in the sole portion. The first groove is disposed on the face side relative to the second groove. The first groove includes the first main inner wall and the first sub inner wall that constitute the inner wall forming the first groove. The first sub inner wall is shorter than the first main inner wall. The second groove includes the second main inner wall and the second sub inner wall that constitute the inner wall forming the second groove. The second sub inner wall is shorter than the second main inner wall. The first main inner wall and the second main inner wall are inclined so as to point upward toward the back side. In such a configuration, in the fourth aspect, further, when the sole portion has been placed on a ground plane, the first main inner wall is inclined more steeply than the second main inner wall relative to the ground plane in a side cross-sectional view. Accordingly, in a description with reference to FIG. 10, which shows an example of the fourth aspect of the present invention, when drawing an imaginary line V4' from the back side end point Q2 of the first main inner wall (a first face side inner wall 11) further toward the back side, and parallel to the inclination of the second main inner wall (a second face side inner wall 21), such an imaginary line V4' and a line corresponding to the first main inner wall (the first face side inner wall 11) intersect so as to draw a line recessed (protruding upward) toward the inside of the head. Due to such a relative inclination relationship formed between the first main inner wall and the second main inner wall, inward deformation of the sole portion when striking a ball is promoted, so the sole portion is more easily deformed when striking a ball, and the rebound performance of the golf club head further improves.

DETAILED DESCRIPTION OF THE PREFERRED EMBODIMENTS

Golf club heads according to several embodiments of the present invention will be described below, with reference to the drawings.

1. First Embodiment 1-1. Outline of Golf Club Head

Figure 1:
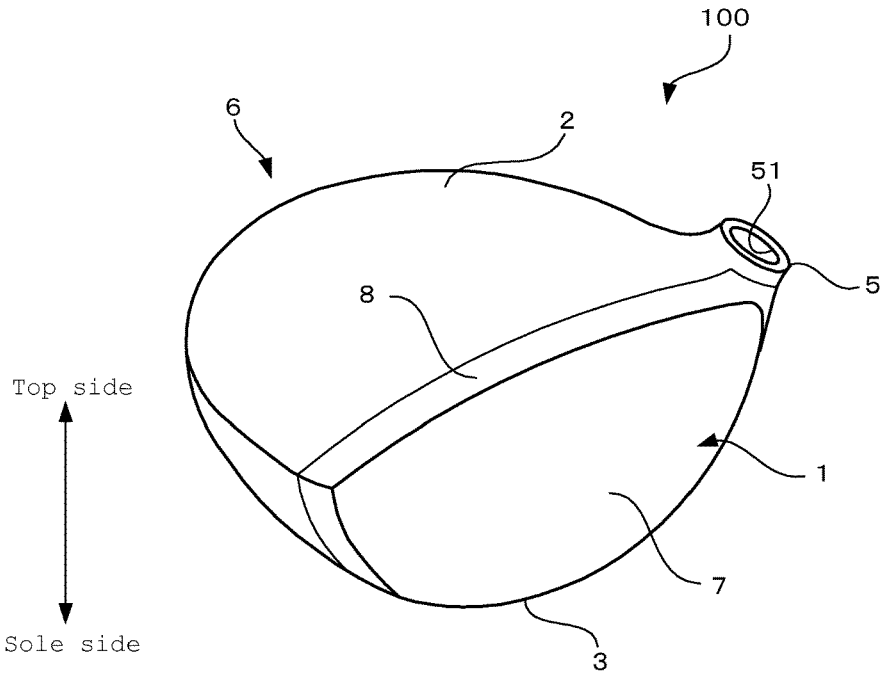
FIG. 1 is a perspective view of a golf club head according to a first embodiment.
Figure 2:
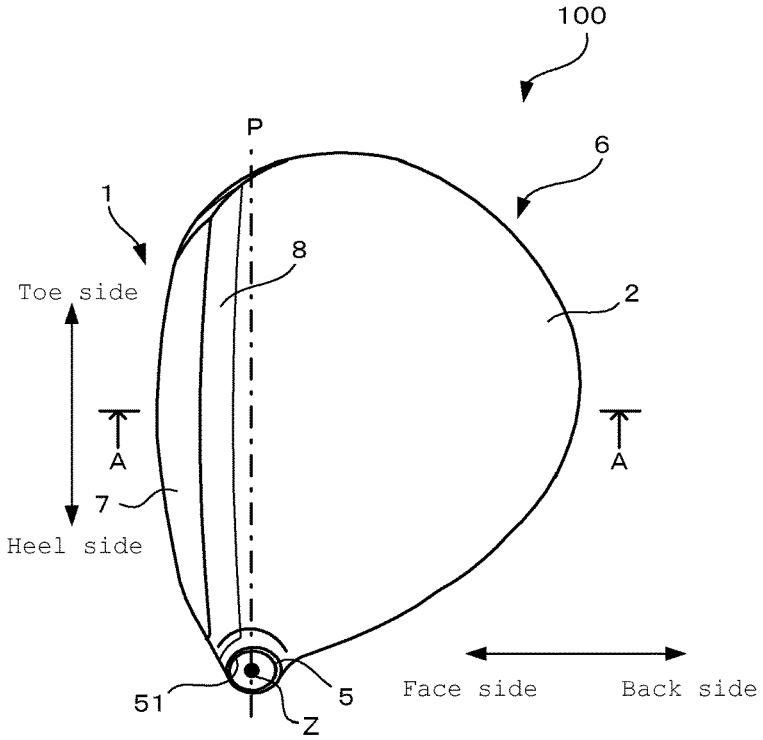
FIG. 2 is a plan view of a reference state of the golf club head according to the first embodiment.

FIG. 1 is a perspective view of a golf club head (hereinafter, may simply be referred to as the "head") 100 according to a first embodiment, and FIG. 2 is a plan view in a reference state of the head 100. The reference state of the golf club head will be described later. The head 100 is a hollow structure, in which a wall surface is formed by a face portion 7, a crown portion 2, a sole portion 3, and a hosel portion 5. The head 100 according to the present embodiment is a driver (1 wood)-type head.

A face member 1 includes the face portion 7, and constitutes a front portion of the head 100 for striking a ball. The crown portion 2 is adjacent to the face portion 7, and constitutes an upper face of the head 100. The crown portion 2 is curved so as to be convex upward. The sole portion 3 constitutes a bottom face of the head 100, and is adjacent to the face portion 7 and the crown portion 2. The sole portion 3 is curved so as to be convex downward. Furthermore, the hosel portion 5 is a portion that is provided adjacent to a heel side of the crown portion 2, and has an insertion hole 51 into which a golf club shaft (not shown) can be inserted. A center axis Z of this insertion hole 51 coincides with the axis of the shaft.

Here, the above reference state will be described. As shown in FIGS. 1 and 2, a state in which the center axis Z of the shaft is included in a perpendicular plane (referred to below as a reference perpendicular plane) P relative to a horizontal plane (ground plane) H (see FIGS. 3 and 4), and the head has been placed on the horizontal plane H at a predetermined lie angle and real loft angle, is prescribed as the reference state. Also, as shown in FIG. 2, a direction of an intersection line of the reference perpendicular plane P and the horizontal plane H will be referred to as a toe-heel direction, and a direction perpendicular to this toe-heel direction and parallel to the horizontal plane H will be referred to as a face-back direction. Also, a direction perpendicular to the horizontal plane H will be referred to as a top-sole direction. Note that in the description of the present embodiment, unless particularly stated otherwise, "front-rear" means the face-back direction, where the face side is the front, and the back side is the rear. Also, unless particularly stated otherwise, "vertical" means the top-sole direction, where the top side is up, and the sole side is down. Furthermore, "extending in the . . . direction" is not limited to a case of extending parallel to the " . . . direction", and may refer to extending generally in the " . . . direction", or may refer to extending at an angle relative to the " . . . direction".

The head 100 can, for example, be formed with a titanium alloy (for example, Ti-6Al-4V) having a specific gravity around 4.4 to 5.0. Apart from a titanium alloy, the head 100 can also be formed using one or a plurality of materials selected from among stainless steel, maraging steel, an aluminum alloy, a magnesium alloy and an amorphous alloy. Also, the head 100 is not limited to metal materials, and can also be formed using fiber-reinforced plastic or the like.

The head 100 according to the present embodiment is configured by assembling a head main body 6 having a hollow structure generally including the crown portion 2, the sole portion 3, and the hosel portion 5; and the face member 1 including mainly the face portion 7. The head main body 6 and the face member 1 can be joined by, for example, welding (TIG (tungsten-inert gas) welding, plasma welding, laser welding, brazing, or the like). The head main body 6 has an opening toward the front, and the face member 1 is attached so as to plug this opening. The head main body 6 can be assembled from a plurality of components, or can be formed as a single body. This sort of head main body 6 and face member 1 can be manufactured using various methods. For example, the head main body 6 can be manufactured by casting such as well-known lost-wax precision casting, or the like. Also, the face member 1 can be manufactured by, for example, a forging manufacturing method, a flat plate pressing process, casting, or the like. Note that the component configuration of the head 100 described here is only an example, and it is also possible to assemble the head 100 from a plurality of components differing from the example given here.

Figure 3:
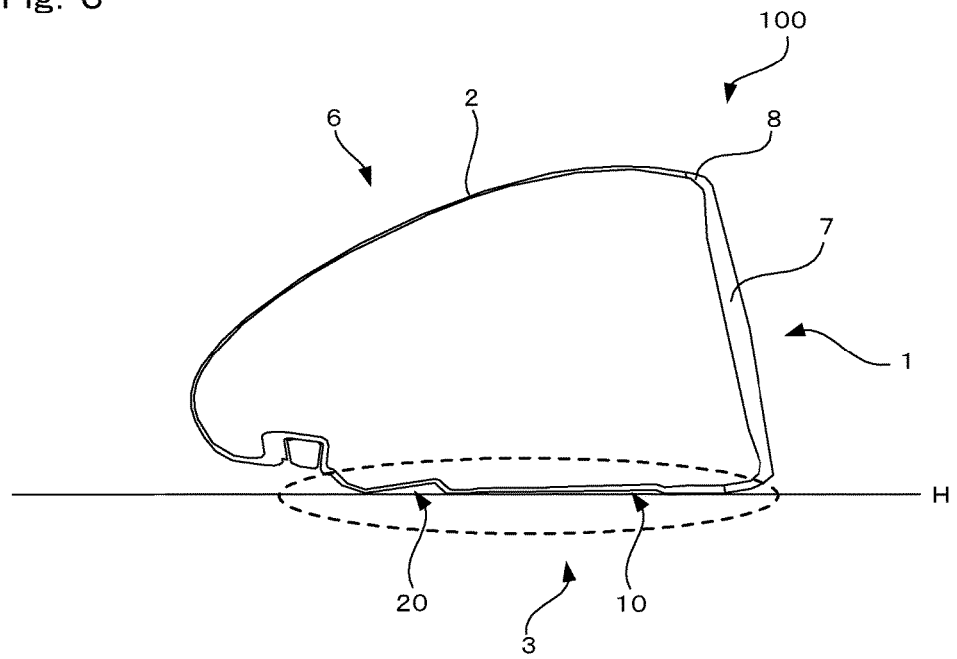
FIG. 3 is cross-sectional view taken along line A-A in FIG. 2.

Following is a description of the face member 1, with reference also to FIG. 3. FIG. 3 is a cross-sectional view taken along line A-A in FIG. 2. As shown in FIGS. 1 to 3, the face member 1 of the present embodiment is a so-called cup-face-type. That is, the face member 1 is formed in a cup shape having the flat plate-like face portion 7 that strikes a ball, and a rising portion (extending portion) 8 that extends rearward from a circumferential edge of the face portion 7. In this sort of cup-face-type face member 1, since a joint portion of the face member 1 and the head body 6, which tends to have high rigidity, is shifted to the rear of the face portion 7, the entire face portion 7 bends more easily. Accordingly, a cup-face structure contributes to an increase in flight distance.

Note that FIG. 3 is a cross-sectional view passing through a face center Fc and orthogonal to the toe-heel direction. Here, the face center Fc is defined as follows. First, on the face portion 7, a line x parallel to the toe-heel direction is drawn at an arbitrary position in the vertical direction, and a midpoint Px of this line x is determined. Next, on the face portion 7, a line y passing through the point Px and parallel to the vertical direction is drawn, and a midpoint Py of this line is determined. Then, a line that passes through the point Py that was determined in this way, and is parallel to the toe-heel direction, is redrawn as the line x, and then a step of re-determining the point Py is repeated in the same manner as described above. In repetition of this step, the new point Py when the distance between the previous point Py and the new point Py becomes 1 mm or less is defined as the face center Fc. Note that the length is measured along the face plane.

Other than the above, in order to increase flight distance, the head 100 is designed to improve the rebound performance of the head 100, particularly the rebound performance of the sole portion 3. Also, the head 100 is designed to achieve a lower center of gravity while also improving rebound performance. Below, these features will be described in detail.

1-2. Structure of Sole Portion

Figure 4:
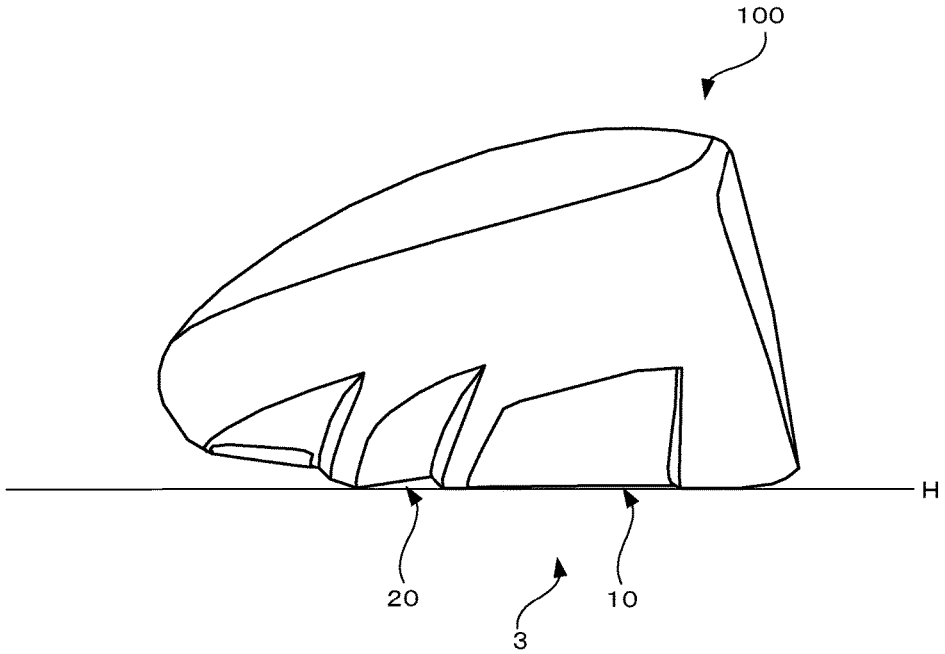
FIG. 4 is a side face view in the reference state in which the golf club head according to the first embodiment is viewed from a toe side.
Figure 5:
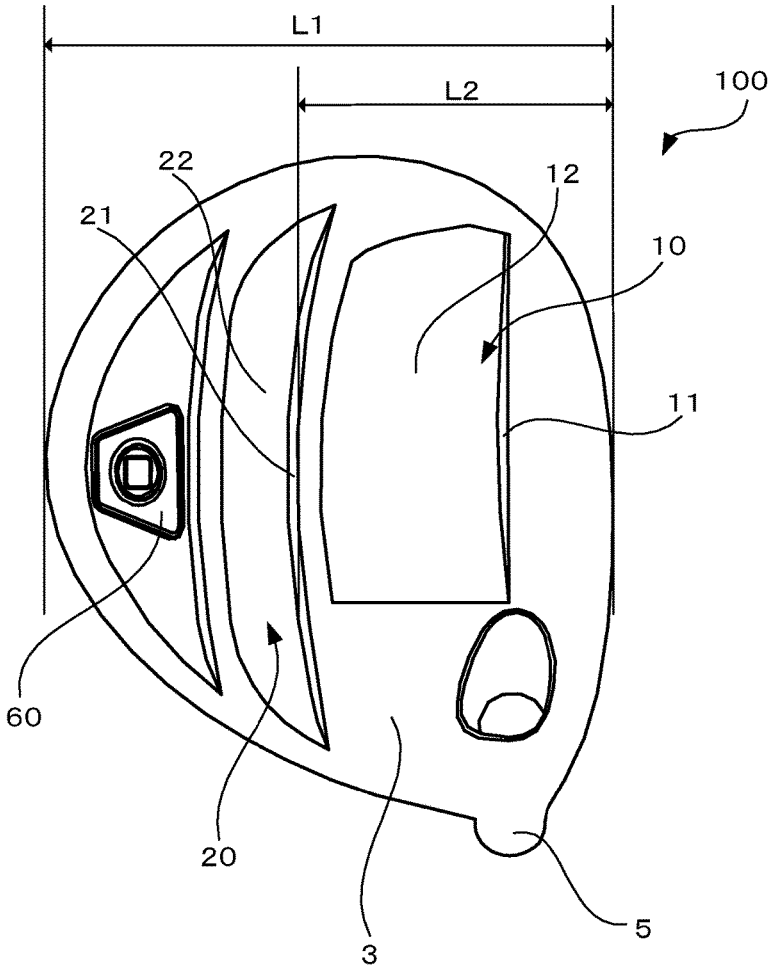
FIG. 5 is a bottom face view in the reference state of the golf club head according to the first embodiment.
Figure 6:
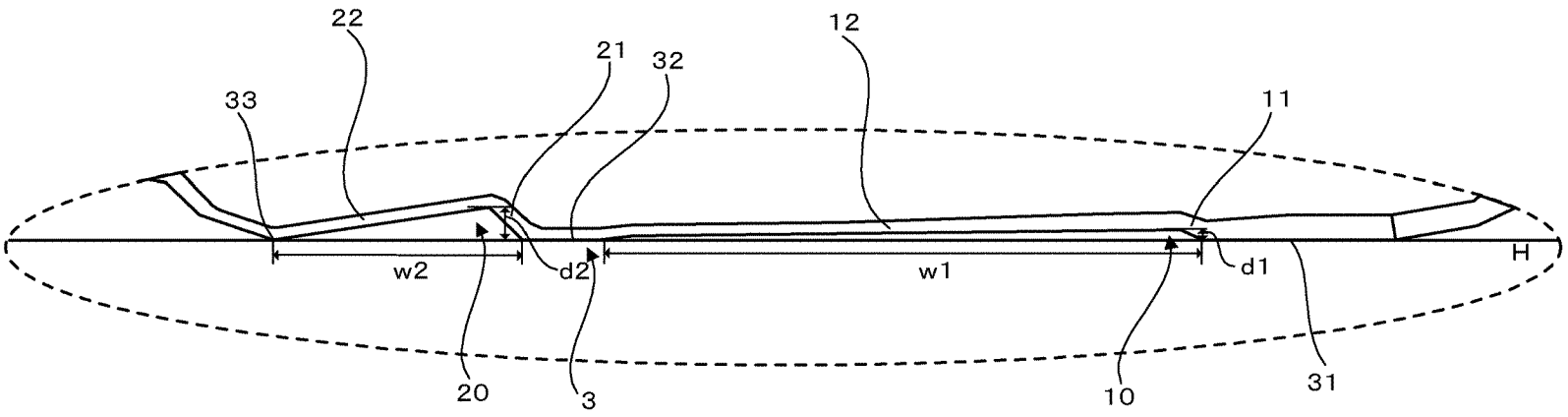
FIG. 6 is a partial enlarged view of a region in the vicinity of a sole portion surrounded by a dotted line in FIG. 3.

FIG. 4 is a side face view in the reference state in which the head 100 is viewed from the toe side, and FIG. 5 is a bottom face view in the reference state of the head 100. FIG. 6 is a partial enlarged view of a region in the vicinity of the sole portion 3 surrounded by a dotted line in FIG. 3. As shown in FIGS. 3 to 6, a plurality (two in the present embodiment) of grooves 10 and 20 recessed toward the inside of the sole portion 3 are formed on the outer face of the sole portion 3. As shown in FIG. 5, both of the grooves 10 and 20 extend in the toe-heel direction. Further, the grooves 10 and 20 are curved so as to be convex toward the back side. In addition, the grooves 10 and 20 are lined up in the face-back direction, and extend generally parallel to each other in the bottom face view. Also, the groove on the face side is the groove 10 (a first groove), and the groove on the back side is the groove 20 (a second groove). Below, the groove 10 is referred to as a first groove 10 and the groove 20 is referred to as a second groove 20.

The first groove 10 and the second groove 20 contribute to reducing the rigidity of the sole portion 3 in the face-back direction. That is, because the first groove 10 and the second groove 20 exist, the sole portion 3 is more easily deformed in the face-back direction when striking a ball, and the rebound performance of the head 100 is increased.

Further, as shown in FIG. 6, the first groove 10 and the second groove 20 according to the present embodiment have a generally triangular shape in a side cross-sectional view. Note that "side cross-section" means a cross-section orthogonal to the toe-heel direction. The first groove 10 is defined by a face side inner wall 11 (a first sub inner wall) that is an inner wall on the face side, and a back side inner wall 12 (a first main inner wall) that is an inner wall on the back side. The face side inner wall 11 and the back side inner wall 12 have a straight shape in a side cross-sectional view. Below, the face side inner wall 11 of the first groove 10 is referred to as a first face side inner wall 11. The back side inner wall 12 of the first groove 10 is referred to as a first back side inner wall 12.

Likewise, the second groove 20 is defined by a face side inner wall 21 (a second sub inner wall) that is an inner wall on the face side, and a back side inner wall 22 (a second main inner wall) that is an inner wall on the back side. The face side inner wall 21 and the back side inner wall 22 have a straight shape in a side cross-sectional view. Below, the face side inner wall 21 of the second groove 20 is referred to as a second face side inner wall 21. The back side inner wall 22 of the second groove 20 is referred to as a second back side inner wall 22.

The first face side inner wall 11 is shorter than the first back side inner wall 12. Likewise, the second face side inner wall 21 is shorter than the second back side inner wall 22. Note that the length of the first back side inner wall 12 in the side cross-sectional view means, in the side cross-sectional view, the length of a straight line connecting both end points (in this case, the end point on the face side and the end point on the back side) of the first back side inner wall 12. This is likewise true also for the lengths in the side cross-sectional view of the second back side inner wall 22, the first face side inner wall 11, and the second face side inner wall 21.

The inner walls 11, 12, 21, and 22 are continuous with portions (a first grounding portion 31, a second grounding portion 32, and a third grounding portion 33, described later) that touch the ground at a ground plane H of the sole portion 3 in the reference state. The first face side inner wall 11 and the second face side inner wall 21 respectively extend diagonally upward toward the rear from the first grounding portion 31 and the second grounding portion 32. In other words, the first face side inner wall 11 and the second face side inner wall 21 are respectively inclined so as to point upward toward the back side. The first back side inner wall 12 and the second back side inner wall 22 respectively extend diagonally upward toward the front from the second grounding portion 32 and the third grounding portion 33. In other words, the first back side inner wall 12 and the second back side inner wall 22 are respectively inclined so as to point upward toward the face side. The first face side inner wall 11 and the first back side inner wall 12 are joined at an end portion at their respective upper sides. This joint portion is a deepest portion of the first groove 10. The second face side inner wall 21 and the second back side inner wall 22 are joined at an end portion at their respective upper sides. This joint portion is a deepest portion of the second groove 20. Note that in the present embodiment, the first back side inner wall 12, the first face side inner wall 11, the second back side inner wall 22, and the second face side inner wall 21 respectively correspond to the first main inner wall, the first sub inner wall, the second main inner wall, and the second sub inner wall in the present invention.

In the present embodiment, the first groove 10 is wider in the front-rear direction and shallower in the vertical direction than the second groove 20. On the other hand, the second groove 20 is narrower in the front-rear direction and deeper in the vertical direction than the first groove 10. Here, when the head 100 is set in the reference state, the depth at the deepest portion of the first groove 10 is referred to as d1, and the width in the front-rear direction is referred to as w1. Also, when the head 100 is set in the reference state, the depth at the deepest portion of the second groove 20 is referred to as d2, and the width in the front-rear direction is referred to as w2. At this time, in the present embodiment, d2>d1, and w1>w2. Note that the depths of the first groove 10 and the second groove 20 mean the depth in the vertical direction from the ground plane H in the reference state of the head 100. Also, in the present embodiment, the width w1 in the front-rear direction of the first groove 10 is a distance between the rear end of the first grounding portion 31 and the front end of the second grounding portion 32, and the width w2 in the front-rear direction of the second groove 20 is a distance between the rear end of the second grounding portion 32 and the front end of the third grounding portion 33.

Incidentally, the face portion is commonly designed to have higher rigidity than the sole portion, because durability against impact when striking balls is sought. Therefore, the rigidity of the sole portion increases in the vicinity of the face portion, and so the sole portion tends to be difficult to deform. Therefore, the groove positioned in the vicinity of the face portion in the sole portion contributes to reducing rigidity of the sole portion, but the degree of that contribution is less than the contribution of the groove positioned on the back side. This is similarly true for the head 100 according to the present embodiment, and the average thickness of the face portion 7 is greater than the average thickness of the sole portion 3, and the face portion 7 has higher rigidity than the sole portion 3. Accordingly, here, as described above, d2>d1. That is, the second groove 20 on the back side is formed relatively deeper due to its effective contribution to reducing rigidity, and the first groove 10 on the face side is formed relatively shallower due to being relatively less likely to contribute to reducing rigidity. As a result, while mainly effectively increasing rebound performance by the second groove 20 on the back side, a rise in the position of the center of gravity is prevented by shallowly forming the first groove 10 on the face side. That is, low center of gravity is achieved.

Also, it is preferable that w1/d1>1, more preferable that w1/d1>3, and still more preferable that w1/d1>6. Under such conditions, the first groove 10 relatively widens in the front-rear direction and becomes shallower in the vertical direction, and two essentially contradictory requirements of improving the rebound performance of the sole portion 3 and lowering the center of gravity of the head 100 can be satisfied with good balance. Similarly, it is preferable that w2/d2>1, more preferable that w2/d2>3, and still more preferable that w2/d2>5. Under such conditions, the second groove 20 relatively widens in the front-rear direction and becomes shallower in the vertical direction, so that the two essentially contradictory requirements of improving the rebound performance of the sole portion 3 and lowering the center of gravity of the head 100 can be satisfied with good balance. Also, from the above viewpoint, it is preferable that 15 mm≤w1≤50 mm, and preferable that 5 mm≤w2≤40 mm. Also, it is preferable that 0.3 mm≤d1≤4 mm, and preferable that 0.5 mm≤d2≤5 mm. Further, it is preferable that d2/w2>d1/w1.

In the present embodiment, quantitative conditions related to d1, d2, w1 and w2 above are established across the entire region in the toe-heel direction where the first groove 10 and the second groove 20 are formed. However, these conditions may also be partially established in the toe-heel direction. In that case, it is preferable that these conditions are satisfied at least in a cross-section passing through the face center Fc and orthogonal to the toe-heel direction, that is, on the cross-section shown in FIGS. 3 and 6.

Here, in the reference state, the length of the head 100 in the face-back direction is referred to as L1, and the length in the face-back direction from the frontmost point (the frontmost point of the leading edge) of the head 100 to the edge on the face side of the second groove 20 is referred to as L2 (see FIG. 5). Note that L1 is the length in the face-back direction from the frontmost point of the head 100 to the rearmost point of the head 100. At this time, in the present embodiment, it is preferable that L2/L1≥0.4, more preferable that L2/L1≥0.45, and still more preferable that L2/L1≥0.5. The reason is that, under such conditions, the second groove 20 will be disposed comparatively rearward. That is, it is unlikely for the second groove 20 to be influenced by the property that the sole portion 3 is not easily deformed due to the high rigidity of the face portion 7, and so it is possible to effectively improve the rebound performance of the sole portion 3.

Further, it is preferable that L2/L1≤0.8, more preferable that L2/L1≤0.7, and still more preferable that L2/L1≤0.6. Under such conditions, the second groove 20 will not be located too far rearward. That is, if the second groove 20 is excessively located to the rear, in other words, if the second groove 20 is too far from the surface of the face, deformation when striking a ball becomes difficult to attain in the vicinity of the second groove 20, and the amount of deflection in the vicinity of the second groove 20 can decrease. Also, even if the second groove 20 becomes too close to the outer shell of the rigid back side of the head 100, the amount of deflection in the vicinity of the second groove 20 can decrease. Accordingly, from the viewpoint of improving rebound performance, it is preferable to adopt a configuration in which the second groove 20 is not located too far rearward.

Because L2 is defined based on the edge on the face side of the curved second groove 20, L2 varies according to position in the toe-heel direction, but in the present embodiment, the numerical conditions related to L2/L1 above are established across the entire region in the toe-heel direction where the groove 20 is formed. However, the above numerical conditions may also be partially established in the toe-heel direction. In that case, it is preferable that the above numerical conditions are satisfied at least in a cross-section passing through the face center Fc and orthogonal to the toe-heel direction, that is, on the cross section shown in FIGS. 3 and 6.

Also, as shown in FIG. 6, in the present embodiment, in the reference state in which the sole portion 3 is placed on the ground plane H, the second back side inner wall 22 is inclined more steeply than the first back side inner wall 12 relative to the ground plane H in the side cross-sectional view. Note that the inclination of the first back side inner wall 12 means, in the side cross-sectional view, inclination of a straight line connecting both end points (in this case, an end point on the face side and an end point on the back side) of the first back side inner wall 12. This is similarly true also regarding inclination of the second back side inner wall 22, the first face side inner wall 11, and the second face side inner wall 21.

In the present embodiment, as shown in FIG. 6, the first back side inner wall 12 and the second back side inner wall 22 respectively constituting the first groove 10 and the second groove 20 are inclined, and particularly are inclined so as to point downward from the face side toward the back side, that is, inclined so that the groove depth decreases. Therefore, it is difficult for the sole portion 3 to catch on the ground plane H (grass) when swinging the golf club, and the sole portion 3 easily slips along the ground plane H. Also, in a case where the first back side inner wall 12 and the second back side inner wall 22 are inclined as in the present embodiment, while obtaining the effect of reducing the rigidity of the sole portion 3 using the first groove 10 and the second groove 20, the first back side inner wall 12 and the second back side inner wall 22 constituting a part of the sole portion 3 can be disposed as low as possible, so an even lower center of gravity can be achieved.

Figure 7:
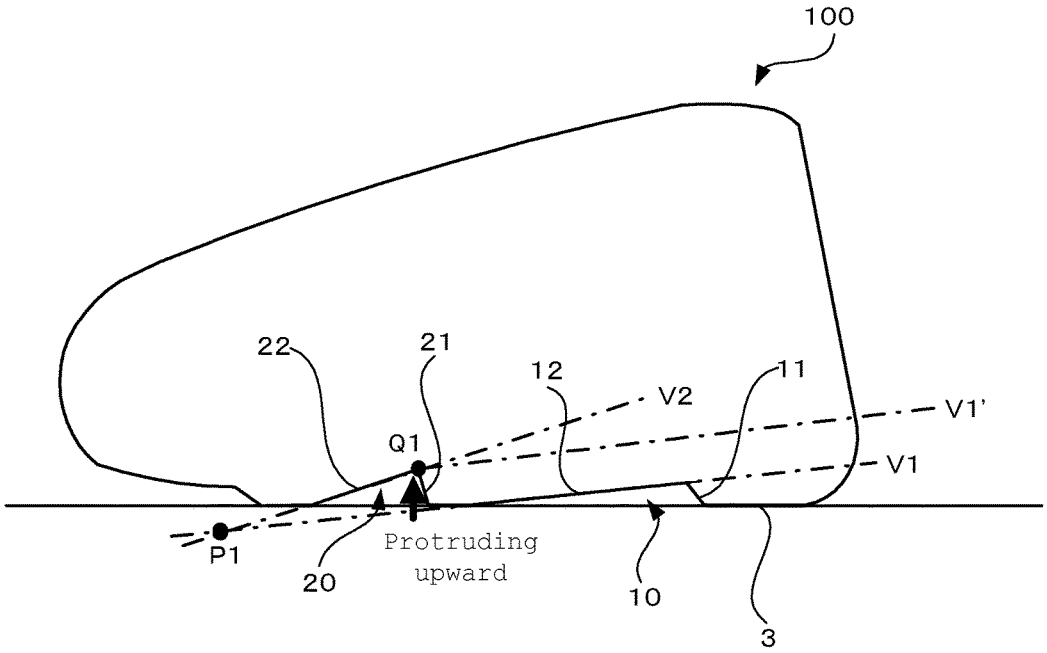
FIG. 7 is a schematic side cross-sectional view of the golf club head according to the first embodiment.

Here, as shown in FIG. 7, in a side cross-sectional view, an imaginary line V1' extending from the face side end point Q1 of the second back side inner wall 22 further toward the face side, and extending parallel to the inclination of the first back side inner wall 12, is considered. At this time, such an imaginary line V1', and a line corresponding to the second back side inner wall 22 (a line extending along the second back side inner wall 22, and not extending from the face side end point Q1 of the second back side inner wall 22 to the face side), intersect so as to draw a line recessed toward the inside of the head 100. In other words, in the side cross-sectional view, the intersecting point P1 of an imaginary line V1 along the inclination of the first back side inner wall 12 and an imaginary line V2 along the inclination of the second back side inner wall 22 is positioned below the golf club head 100 and on the back side relative to the second groove 20. Incidentally, due to the existence of the first groove 10 and the second groove 20 recessed inside the sole portion 3, the sole portion 3 is easily deformed inward of the head 100 when striking a ball. On the other hand, due to the relative inclination relationship between the first back side inner wall 12 and the second back side inner wall 22 as described above, inward deformation of the head 100 in the sole portion 3 is promoted, and the rebound performance of the golf club head 100 further improves. Note that in order to facilitate understanding of this description, FIG. 7 is a schematic side cross-sectional view of the head 100, in which features of the shapes of the first groove 10 and the second groove 20 are emphasized.

In the present embodiment, the first back side inner wall 12 and the second back side inner wall 22 extend in a straight line in the side cross-sectional view. Therefore, portions in the vicinity of the first groove 10 and the second groove 20, including these portions 12 and 22, are easily bent toward the inside of the head 100. Note that in other embodiments, it is not necessary for these portions 12 and 22 to extend in a straight line, and for example, they may be curved in a concave shape toward the inside of the sole portion 3 in the side cross-sectional view. Similarly in this case as well, the sole portion 3 of the head 100 is easily bent inwardly. Also, in these cases as well, the inclinations of the first back side inner wall 12 and the second back side inner wall 22 respectively, in the side cross-sectional view, are defined as the inclination of the straight line connecting both end points (in this case, the end point on the face side and the end point on the back side) of the first back side inner wall 12 and the second back side inner wall 22.

The lower end of the first face side inner wall 11, that is, the front end of the first groove 10, is in contact with the ground plane H in the reference state of the head 100. The lower end of the first back side inner wall 12, that is, the rear end of the first groove 10, is in contact with the ground plane H in the reference state of the head 100. Similarly, the lower end of the second face side inner wall 21, that is, the front end of the second groove 20, is in contact with the ground plane H in the reference state of the head 100. The lower end of the second back side inner wall 22, that is, the rear end of the second groove 20, is in contact with the ground plane H in the reference state of the head 100. As a result, the head 100 contacts the ground plane H in the reference state at three points of the first grounding portion 31, the second grounding portion 32, and the third grounding portion 33 included in the sole portion 3. Note that the first grounding portion 31, the first groove 10, the second grounding portion 32, the second groove 20, and the third grounding portion 33 are arranged in this order from the face side toward the back side. As described above, when the golfer holds the head 100 in the reference state, the head 100 is supported at a plurality of points on the ground plane H, and the head 100 is stable. Note that even if any one of the first grounding portion 31, the second grounding portion 32, and the third grounding portion 33 is omitted, for example even if the third grounding portion 33 is omitted, the head 100 can be supported at two points, so the head 100 can be stabilized. Also, in the present embodiment, the first grounding portion 31 and the second grounding portion 32 are flat in the side cross-sectional view and are in contact in a line with the ground plane H in the side cross-sectional view. Accordingly, it is difficult for the head 100 in the reference state to fall forward or rearward, so the head 100 in the reference state is further stabilized.

Figure 11:
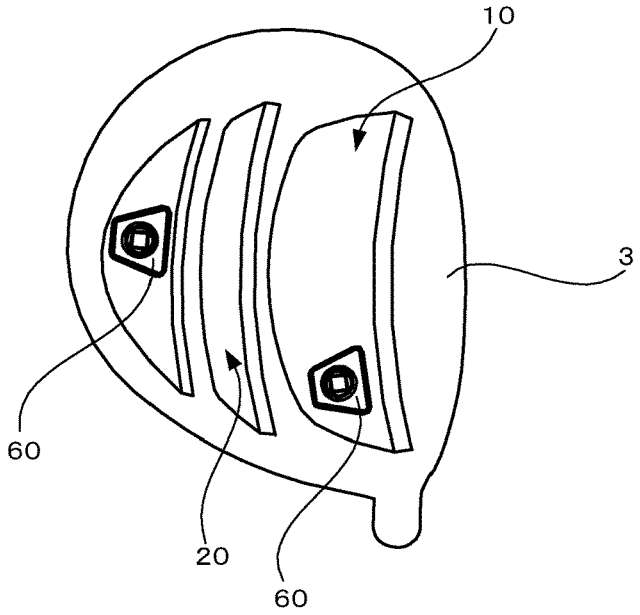
FIG. 11 is a bottom face view in a reference state of a golf club head according to a variation.
Figure 12:
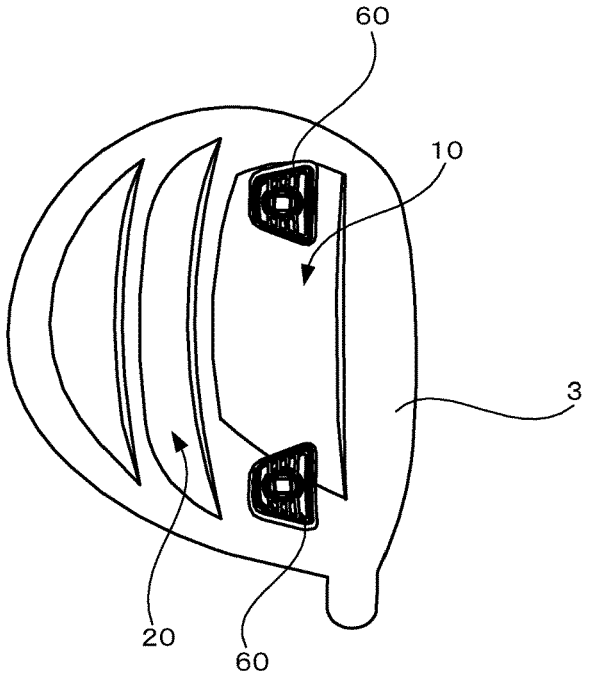
FIG. 12 is a bottom face view in a reference state of a golf club head according to another variation.

Here, returning to FIG. 5, the second groove 20 is formed, on the sole portion 3, across generally the entire region in the toe-heel direction, and the first groove 10 is formed, on the sole portion 3, only at a position nearer the toe-side in the toe-heel direction. Accordingly, in the present embodiment, the first groove 10 on the face side is shorter in the toe-heel direction than the second groove 20 on the back side. As a result, the rebound performance is particularly improved at the position in the toe-heel direction where the first groove 10 is formed, that is, at the position on the toe side. Note that the position in the toe-heel direction where the first groove 10 can be formed is not limited to the example here. That is, the first groove 10 can be selectively formed at an arbitrary position in the toe-heel direction where the rebound performance is particularly desired to be improved. However, as shown in FIGS. 11 and 12, the first groove 10 may be formed on the sole portion 3 across generally the entire region in the toe-heel direction.

Figure 13:
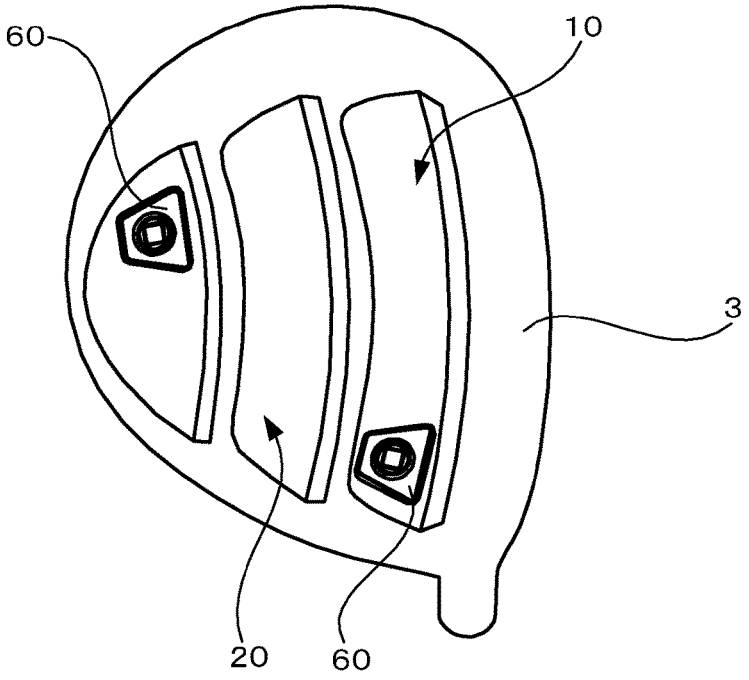
FIG. 13 is a bottom face view in a reference state of a golf club head according to still another variation.

In the present embodiment, in the bottom face view, the first groove 10 and the second groove 20 depict circular arcs (curved lines) in which the vicinity of the center in the toe-heel direction protrudes toward the back side. As a result, the distance from the face center Fc where striking points concentrate to the first groove 10 can be generally equal across the entire region of the first groove 10 in the toe-heel direction. Similarly with regard to the second groove 20, the distance from the face center Fc to the second groove 20 can be generally equal across the entire region of the second groove 20 in the toe-heel direction. Thus, it is possible to effectively deform the vicinity of the first groove 10 and the second groove 20 when striking a ball. Also note that the first groove 10 can be formed in a convex shape as described above, or can be formed so as to extend parallel to the toe-heel direction, or conversely, as shown in FIG. 13, can be formed depicting a circular arc (curved line) such that the vicinity of the center in the toe-heel direction protrudes toward the face side. This is similarly true regarding the second groove 20.

Also, in the present embodiment, a weight 60 for adjusting the position of the center of gravity is attached to the sole portion 3, and thus the center of gravity is lowered further. In the example of FIG. 5, the weight 60 is disposed approximately in the vicinity of the center in the toe-heel direction to the rear of the sole portion 3, and is adjusted so that the center of gravity of the head 100 approaches the center on the back side. Note that the quantity of weights 60 and the position where they are attached are not limited to the example here, and any quantity of weights 60 can be attached at an arbitrary position according to the position of the center of gravity that is the design target. For example, in the example of FIG. 11, a weight 60 is attached not only to the rear of the sole portion 3 but also to a heel side position in the first groove 10, so that the center of gravity can approach the heel side. Further, in the example of FIG. 12, there is no weight 60 to the rear of the sole portion 3, and weights 60 are attached at two locations on the toe side and the heel side in the first groove 10, and so the center of gravity can be brought closer to the face side. In the example of FIG. 13, a weight 60 located to the rear of the sole portion 3 is moved slightly toward the toe side and a weight 60 is also attached to a position on the heel side in the first groove 10.

2. Second Embodiment

Figure 8A:
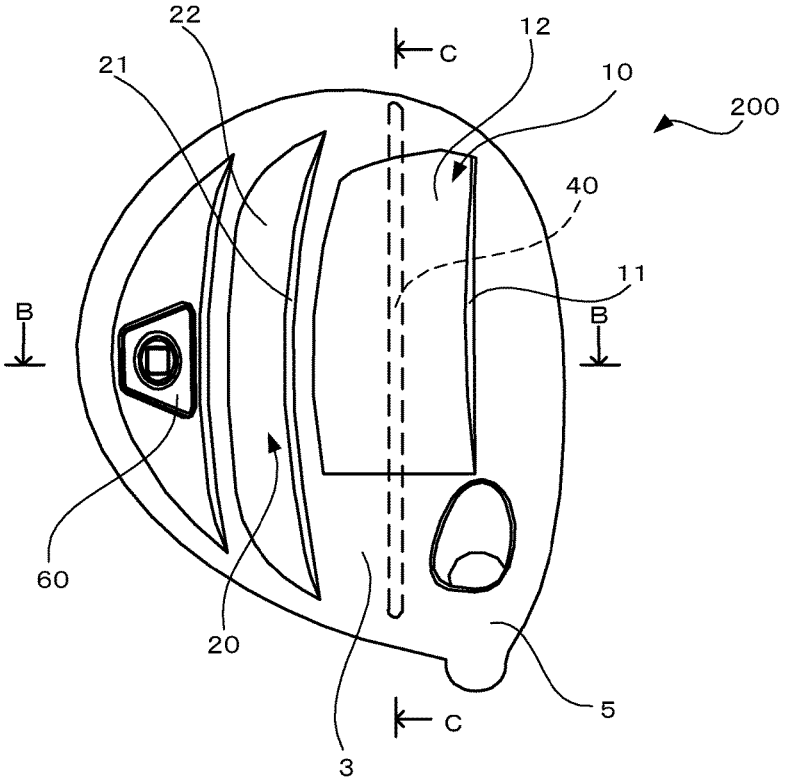
FIG. 8A is a bottom face view in a reference state of a golf club head according to a second embodiment.
Figure 8B:
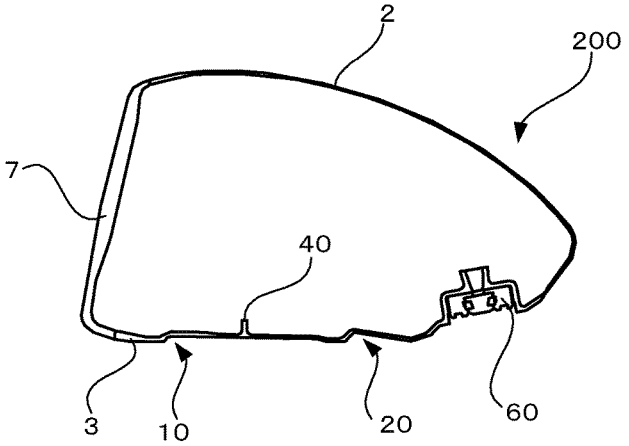
FIG. 8B is cross-sectional view taken along line B-B in FIG. 8A.
Figure 8C:
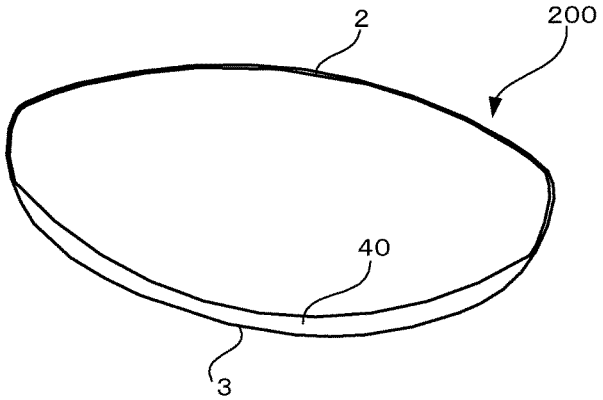
FIG. 8C is cross-sectional view taken along line C-C in FIG. 8A.

Following is a description of a golf club head 200 according to a second embodiment, with reference to FIGS. 8A to 8C. Note that the head 200 according to the second embodiment shares many portions with the head 100 according to the first embodiment. Therefore, in the following description, for the sake of simplicity, the same reference numerals are attached to elements common to the first embodiment and a description of those elements will be omitted here, and mainly only differences from the first embodiment will be described.

The main difference between the head 200 according to the second embodiment and the head 100 according to the first embodiment is that a rib (which can also be referred to as a thick portion, also true below) 40 is formed on the inside face of the sole portion 3. Note that because the rib 40 is formed on the inside face of the sole portion 3, the rib 40 basically cannot be visually recognized in the bottom face view, but in FIG. 8A, for convenience of description, the rib 40 is indicated by a broken line. As shown in FIGS. 8A to 8C, the rib 40 extends in the toe-heel direction in the vicinity of the center of the face-back direction of the first back side inner wall 12. In particular, in the present embodiment, the rib 40 extends across generally the entire region of the toe-heel direction. Also, in FIG. 8A, the rib 40 extends in a straight line, but for example, the rib 40 may also be curved so as to be convex toward the back side so as to follow the shape of the first groove 10.

Even if such a rib 40 is provided, since the increase in rigidity in the face-back direction is small, it is possible to substantially maintain the rebound performance in the face-back direction. On the other hand, since the rib 40 can increase the rigidity in the toe-heel direction of the sole portion 3, the pitch of a ball-striking sound can be heightened.

This sort of rib 40 is not limited to the first back side inner wall 12, and can also be formed in the second back side inner wall 22. Also, such a rib 40 may be provided at a plurality of locations.

3. Third Embodiment

Figure 9A:
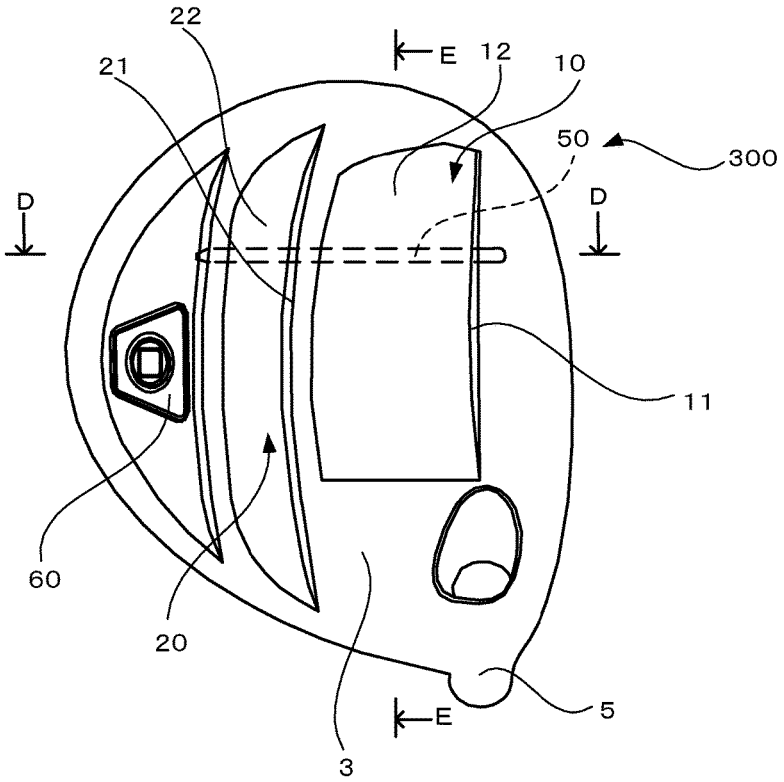
FIG. 9A is a bottom face view in a reference state of a golf club head according to a third embodiment.
Figure 9B:
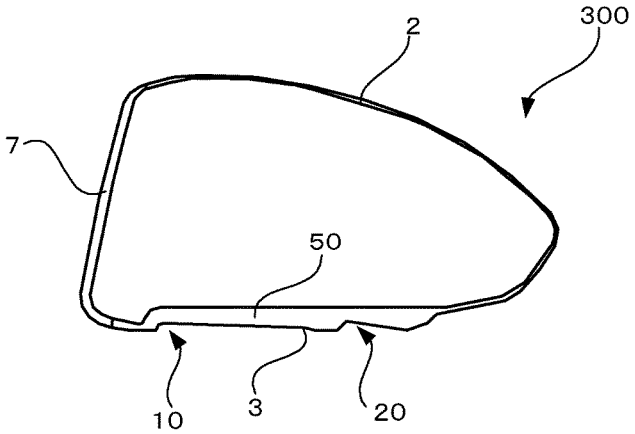
FIG. 9B is cross-sectional view taken along line D-D in FIG. 9A.
Figure 9C:
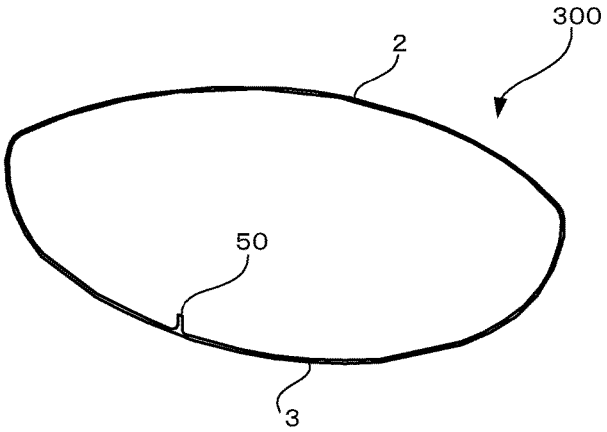
FIG. 9C is cross-sectional view taken along line E-E in FIG. 9A.

Following is a description of a golf club head 300 according to a third embodiment, with reference to FIGS. 9A to 9C. Note that the head 300 according to the third embodiment shares many portions with the head 100 according to the first embodiment. Therefore, in the following description, for the sake of simplicity, the same reference numerals are attached to elements common to the first embodiment and a description of those elements will be omitted here, and mainly only differences from the first embodiment will be described.

The main difference between the head 300 according to the third embodiment and the head 100 according to the first embodiment is that a rib (which can also be referred to as a thick portion, also true below) 50 is formed on the inside face of the sole portion 3. Note that because the rib 50 is formed on the inside face of the sole portion 3, the rib 50 basically cannot be visually recognized in the bottom face view, but in FIG. 9A, for convenience of description, the rib 50 is indicated by a broken line. As shown in FIGS. 9A to 9C, the rib 50 extends in the face-back direction across both the first groove 10 and the second groove 20. Particularly in the present embodiment, the rib 50 completely traverses the first groove 10 and the second groove 20. However, the rib 50 can also be configured so as to only extend to a position of the first groove 10, and not overlap the position of the second groove 20.

In the present embodiment, the rib 50 is disposed at a position closer to the toe on the sole portion 3. As a result, the rigidity of the sole portion 3 can be increased and the rebound performance can be suppressed at the position in the toe-heel direction where the rib 50 is formed, that is, at the position on the toe side. On the other hand, at the position where the rib 50 is not provided in the toe-heel direction, improvement of the rebound performance by the first groove 10 and the second groove 20 is maintained. Note that the position in the toe-heel direction where the rib 50 can be formed is not limited to the example here, and it is possible to selectively form the rib 50 at an arbitrary position in the toe-heel direction where it is desired to suppress the rebound performance. Also, such a rib 50 can be provided at a plurality of locations.

4. Fourth Embodiment

Figure 10:
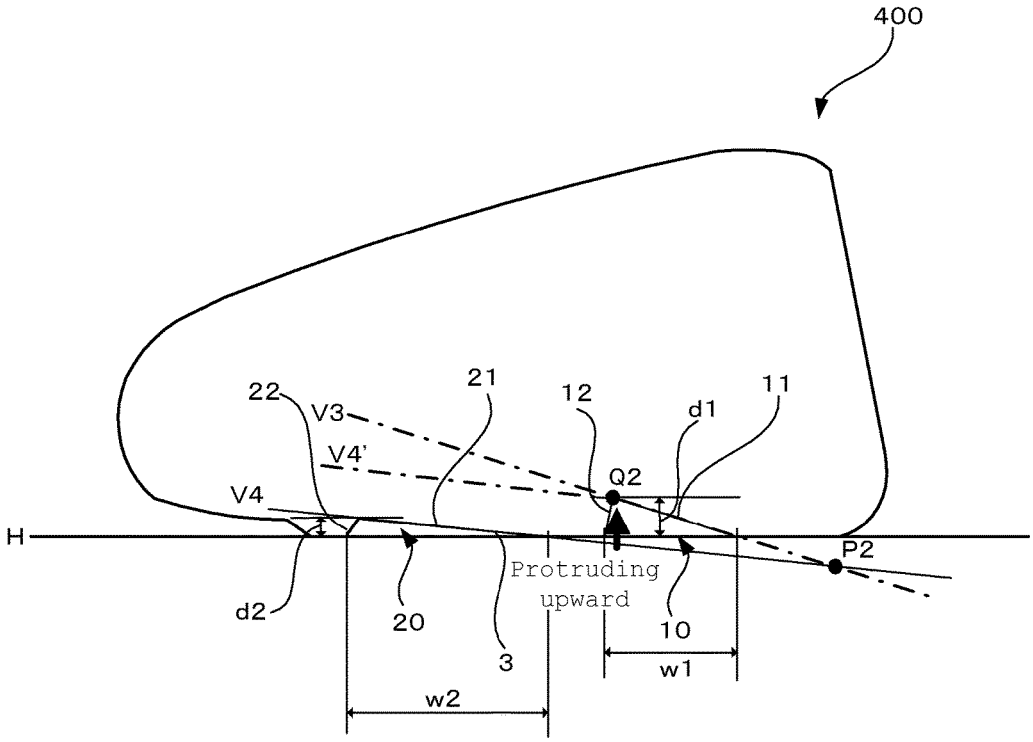
FIG. 10 is a schematic side cross-sectional view of a golf club head according to a fourth embodiment.

Following is a description of a golf club head 400 according to a fourth embodiment, with reference to FIG. 10. Note that the head 400 according to the fourth embodiment shares many portions with the head 100 according to the first embodiment. Therefore, in the following description, for the sake of simplicity, the same reference numerals are attached to elements common to the first embodiment and a description of those elements will be omitted here, and mainly only differences from the first embodiment will be described.

The main difference between the head 400 according to the fourth embodiment and the head 100 according to the first embodiment is the slope of the inner walls 11, 12, 21, and 22 defining the first groove 10 and the second groove 20. As shown in FIG. 10, in the present embodiment, a configuration is adopted in which the first back side inner wall 12 is shorter than the first face side inner wall 11, and the second back side inner wall 22 is shorter than the second face side inner wall 21. In the present embodiment, the first face side inner wall 11, the first back side inner wall 12, the second face side inner wall 21, and the second back side inner wall 22 respectively correspond to the first main inner wall, the first sub inner wall, the second main inner wall, and the second sub inner wall in the present invention.

Further, the first groove 10 is narrower in the front-rear direction and deeper in the vertical direction than the second groove 20. Also, the second groove 20 is wider in the front-rear direction and shallower in the vertical direction than the first groove 10. That is, contrary to the first embodiment, $d1>d2$, and $w2>w1$. In the present embodiment, $d2/w2<d1/w1$.

Also, in the present embodiment, in the reference state where the sole portion 3 is placed on the ground plane H, the first face side inner wall 11 is inclined more steeply than the second face side inner wall 21 relative to the ground plane H in the side cross-sectional view.

Here, as shown in FIG. 10, in a side cross-sectional view, an imaginary line V4' extending from a back side end point Q2 of the first face side inner wall 11 further toward the back side, and extending parallel to the inclination of the second face side inner wall 21, is considered. At this time, such an imaginary line V4', and a line corresponding to the first face side inner wall 11 (a line extending along the first face side inner wall 11, and not extending from the back side end point Q2 of the first face side inner wall 11 to the back side), intersect so as to draw a line recessed toward the inside of the head 400. In other words, in the side cross-sectional view, the intersecting point P2 of an imaginary line V3 along the inclination of the first face side inner wall 11 and an imaginary line V4 along the inclination of the second face side inner wall 21 is positioned below the golf club head and on the face side relative to the first groove 10. As a result, in the fourth embodiment as well, as in the first embodiment, deformation inward in the sole portion 3 is promoted when striking a ball, and the rebound performance of the golf club head 400 improves. Note that in order to facilitate understanding of this description, FIG. 10 is a schematic side cross-sectional view of the head 400, in which features of the shapes of the first groove 10 and the second groove 20 are emphasized.

In the present embodiment, the first face side inner wall 11 and the second face side inner wall 21 extend in a straight line in the side cross-sectional view. Therefore, portions in the vicinity of the first groove 10 and the second groove 20, including these portions 11 and 21, are easily bent toward the inside of the head 400. Note that in other embodiments, it is not necessary for these portions 11 and 21 to extend in a straight line, and for example, they may be curved in a concave shape toward the inside of the sole portion 3 in the side cross-sectional view. Similarly in this case as well, the sole portion 3 of the head 400 is easily bent inwardly.

At least one of the ribs 40 and 50 of the second and third embodiments can be formed also in the head 400 according to the fourth embodiment.

5. Variations

Several embodiments of the present invention are described above, but the present invention is not limited to the above embodiments, and various modifications that do not depart from the gist of the invention can be made. For example, the below changes are possible. Also, the gist of the following variations can be combined as appropriate.

5-1

In the above first embodiment, the first back side inner wall 12 extends across approximately the entire region of the width w1 of the face-back direction of the first groove 10. Also, the second back side inner wall 22 extends across the majority of the width w2 in the face-back direction of the second groove 20. However, the first back side inner wall 12 and the second back side inner wall 22 are not limited to this.

In the present invention, "main inner wall" means an inner wall where, among the plurality of inner walls forming each groove, the length in the face-back direction is more than 50% of the width (length) in the face-back direction of each groove. Only one "main inner wall" exists in each groove. Also, in the present invention, "sub inner wall" means an inner wall whose length is shorter than the "main inner wall".

That is, in the first embodiment, the first back side inner wall 12 and the second back side inner wall 22 correspond to the "main inner wall". Therefore, as long as the first back side inner wall 12 and the second back side inner wall 22 each have a length of more than 50% of the width (length) of the first groove 10 and the second groove 20 in the face-back direction, their length is not limited. Note that in the first embodiment, the first face side inner wall 11 and the second face side inner wall 21 correspond to a "sub inner wall". The length of these inner walls 11 and 21 can be appropriately changed.

Note that similar modifications are possible with respect to the fourth embodiment. For example, in the fourth embodiment, the first face side inner wall 11 and the second face side inner wall 21 correspond to the "main inner wall" of the present invention. Therefore, also in the fourth embodiment, as long as the first face side inner wall 11 and the second face side inner wall 21 each have a length of more than 50% of the width (length) of the first groove 10 and the second groove 20 in the face-back direction, their length is not limited.

5-2

The inclination angles of the respective inner walls forming the first groove 10 and the second groove 20 also are not limited to those shown in the above first embodiment. In a first aspect of the present invention, as long as the first main inner wall and the second main inner wall are inclined so as to point upward toward the face side, and the second main inner wall is inclined more steeply than the first main inner wall relative to the ground plane in the side cross-sectional view, the inclination angle of another inner wall is not particularly limited. For example, in the first embodiment, the first back side inner wall 12 corresponds to the first main inner wall of the present invention, and the second back side inner wall 22 corresponds to the second main inner wall of the present invention. Therefore, the inclination angles of the first back side inner wall 12 and the second back side inner wall 22 can be appropriately changed as long as the first back side inner wall 12 and the second back side inner wall 22 have the above-described inclination relationship of the present invention.

Also, in the first embodiment, the inclination angles of the first face side inner wall 11 and the second face side inner wall 21 are not particularly limited. For example, the inner walls 11 and 21 may extend diagonally upward toward the front, or may extend in the vertical direction.

Note that similar modifications are possible with respect to the fourth embodiment. For example, in the fourth embodiment, the first face side inner wall 11 corresponds to the first main inner wall of the present invention, and the second face side inner wall 21 corresponds to the second main inner wall of the present invention. Therefore, also in the fourth embodiment, as long as the first face side inner wall 11 and the second face side inner wall 21 are inclined so as to point upward toward the back side, and the first face side inner wall 11 is inclined more steeply than the second face side inner wall 21 relative to the ground plane in the side cross-sectional view, the inclination angle of the first face side inner wall 11 and the second face side inner wall 21 can be appropriately changed.

5-3

Also, in the above first embodiment, the first groove 10 is constituted by two inner walls of the first back side inner wall 12 disposed on the back side and the first face side inner wall 11 disposed on the face side. The second groove 20 is constituted by two inner walls, the second back side inner wall 22 disposed on the back side and the second face side inner wall 21 disposed on the face side. However, the present invention is not limited to this configuration, as long as the first groove includes a first main inner wall and at least one of a first sub inner wall constituting an inner wall forming the first groove, and the second groove includes a second main inner wall and at least one of a second sub inner wall constituting an inner wall forming the second groove. For example, in the first embodiment, the first back side inner wall 12 corresponds to the first main inner wall of the present invention, and the first face side inner wall 11 corresponds to the first sub inner wall of the present invention. The second back side inner wall 22 corresponds to the second main inner wall of the present invention, and the second face side inner wall 21 corresponds to the second sub inner wall of the present invention.

Therefore, for example, in the first embodiment, one or more other inner walls may be interposed between the first face side inner wall 11 and the first back side inner wall 12. Also, one or more other inner walls may be interposed between the first face side inner wall 11 and the first grounding portion 31. One or more other inner walls may be interposed between the first back side inner wall 12 and the second grounding portion 32. When other inner walls intervene in this way, the cross-sectional shape of the groove has a polygonal shape corresponding to the quantity of those inner walls. Also, the configuration of the inner wall of the second groove 20 can be modified in the same manner as the first groove 10. For example, in the second groove 20, other inner walls other than the second face side inner wall 21 and the second back side inner wall 22 may be added.

Also, similar modifications are possible with respect to the fourth embodiment. For example, in the first groove 10 of the fourth embodiment, other inner walls other than the first face side inner wall 11 and the first back side inner wall 12 may be added. Also, in the second groove 20, other inner walls other than the second face side inner wall 21 and the second back side inner wall 22 may be added.

5-4

In the above embodiment, the quantity of grooves formed in the sole portion 3 is two, but the quantity of grooves is not limited to this, and may be three or more. In this case, two adjacent grooves correspond to the first groove and the second groove in the present invention.

5-5

In the above embodiment, the golf club head is a driver-type-head, but the head type is not limited, and may be another wood type such as a fairway wood, or may be a so-called utility-type-head, a hybrid-type-head, or the like.

5-6

The face member 1 does not need to be a cup-face-type, and for example, in a plate-type face member with the rising portion 8 omitted, it is possible to weld to an opening portion formed in the face portion.

REFERENCE SIGNS LIST

2 Crown portion
3 Sole portion

7 Face portion
10 Groove (first groove)
20 Groove (second groove)
11 Face side inner wall (first face side inner wall)
12 Back side inner wall (first back side inner wall)
21 Face side inner wall (second face side inner wall)
22 Back side inner wall (second back side inner wall)
31 First grounding portion
32 Second grounding portion
33 Third grounding portion
40 Rib
50 Rib
H Ground plane

The invention claimed is:

1. A golf club head having a hollow structure, the golf club head comprising a face portion, a crown portion, and a sole portion;

wherein in the sole portion, a first groove and a second groove are formed extending in a toe-heel direction and recessed toward the inside of the sole portion, the first groove being disposed on a face side relative to the second groove, the first groove including a first main inner wall and at least one of a first sub inner wall shorter than the first main inner wall, constituting an inner wall forming the first groove, the second groove including a second main inner wall and at least one of a second sub inner wall shorter than the second main inner wall, constituting an inner wall forming the second groove, the first main inner wall and the second main inner wall being inclined so as to point upward toward the face side, and the second main inner wall, when the sole portion has been placed on a ground plane, being inclined more steeply than the first main inner wall relative to the ground plane in a side cross-sectional view, wherein L2/L1 is ≥0.4 and L2/L1 is ≤0.8, where L1 is a length of the head in a face-back direction and L2 is a length in the face-back direction from a frontmost point of the head to an edge on the face side of the second groove on a cross-sectional plane passing through a face center and orthogonal to the toe-heel direction.

2. The golf club head according to claim 1, wherein the first groove is configured with the first main inner wall disposed on a back side, and one of the first sub inner walls disposed on the face side, and the second groove is configured with the second main inner wall disposed on the back side, and one of the second sub inner walls disposed on the face side.

3. The golf club head according to claim 1, wherein in the side cross-sectional view, an imaginary line along an inclination of the first main inner wall and an imaginary line along an inclination of the second main inner wall intersect at a position on a back side relative to the second groove and below the sole portion.

4. The golf club head according to claim 2, wherein in the side cross-sectional view, an imaginary line along an inclination of the first main inner wall and an imaginary line along an inclination of the second main inner wall intersect at a position on a back side relative to the second groove and below the sole portion.

5. The golf club head according to claim 1, wherein in the side cross-sectional view, each of the first main inner wall and the second main inner wall is formed in the shape of a straight line, or curved in a concave shape toward the inside of the sole portion.

6. The golf club head according to claim 1, wherein the sole portion further includes a first grounding portion positioned on the face side relative to the first groove and contacting the ground plane when the sole portion has been placed on the ground plane, and a second grounding portion positioned between the first groove and the second groove and contacting the ground plane when the sole portion has been placed on the ground plane.

7. The golf club head according to claim 6, wherein in the side cross-sectional view, the first grounding portion and the second grounding portion are configured so as to contact the ground plane in a line when the sole portion has been placed on the ground plane.

8. The golf club head according to claim 6, wherein the sole portion further includes a third grounding portion positioned on a back side relative to the second groove and contacting the ground plane when the sole portion has been placed on the ground plane.

9. The golf club head according to claim 7, wherein the sole portion further includes a third grounding portion positioned on a back side relative to the second groove and contacting the ground plane when the sole portion has been placed on the ground plane.

10. The golf club head according to claim 1, wherein the first groove is shorter than the second groove in the toe-heel direction.

11. The golf club head according to claim 1, wherein d2>d1 and w1>w2, where d1 is a depth of a deepest portion of the first groove, w1 is a width in a front-rear direction of the first groove, d2 is a depth of a deepest portion of the second groove and w2 is a width in a front-rear direction of the second groove.

12. The golf club head according to claim 11, where w1/d1>3 and w2/d2>3.

13. The golf club head according to claim 11, where w1≥15 mm, w1≤50 mm, w2≥5 mm, w2≤40 mm, d1≥0.3 mm, d1≤4 mm, d2≥0.5 mm, d2≤5 mm.

14. The golf club head according to claim 1, where w1/d1>3 and w2/d2>3.

15. A golf club head having a hollow structure, the golf club head comprising a face portion, a crown portion, and a sole portion, wherein in the sole portion, a first groove and a second groove are formed extending in a toe-heel direction and recessed toward the inside of the sole portion, the first groove being disposed on a face side relative to the second groove, the first groove including a first main inner wall and at least one of a first sub inner wall shorter than the first main inner wall, constituting an inner wall forming the first groove, the second groove including a second main inner wall and at least one of a second sub inner wall shorter than the second main inner wall, constituting an inner wall forming the second groove, the first main inner wall and the second main inner wall being inclined so as to point upward toward the face side, the second main inner wall, when the sole portion has been placed on a ground plane, being inclined more steeply than the first main inner wall relative to the ground plane in a side cross-sectional view, and in a bottom view, at least one of the first groove and the second groove is curved to be convex backwards, wherein L2/L1 is ≥0.4 and L2/L1 is ≤0.8, where L1 is a length of the head in a face-back direction and L2 is a length in the face-back direction from a frontmost point of the head to an edge on the face side of the second groove on a cross-sectional plane passing through a face center and orthogonal to the toe-heel direction.

16. The golf club head according to claim 15, wherein d2>d1 and w1>w2, where d1 is a depth of a deepest portion of the first groove, w1 is a width in a front-rear direction of the first groove, d2 is a depth of a deepest portion of the second groove and w2 is a width in a front-rear direction of the second groove.

17. The golf club head according to claim 16, where w1/d1>3 and w2/d2>3.

18. The golf club head according to claim 16, where w1≥15 mm, w1≤50 mm, w2≥5 mm, w2≤40 mm, d1≥0.3 mm, d1≤4 mm, d2≥0.5 mm, d2≤5 mm.

19. The golf club head according to claim 15, where w1/d1>3 and w2/d2>3.

* * * * *